US005733035A

United States Patent [19]

Spencer et al.

[11] Patent Number: 5,733,035

[45] Date of Patent: Mar. 31, 1998

[54] NIGHT-LIGHT TABLE

[76] Inventors: Phillip Anthony Spencer; Patricia Garland Spencer, both of 4292 Benchmark Trace, Tallahassee, Fla. 32311

[21] Appl. No.: 558,890

[22] Filed: Nov. 16, 1995

[51] Int. Cl.[6] ..... A47B 13/16

[52] U.S. Cl. ..... 362/128; 362/136; 362/140; 312/224

[58] Field of Search ..... 362/33, 84, 97, 362/135, 136, 137, 140, 141, 142, 128, 129, 125; 312/224

[56] References Cited

U.S. PATENT DOCUMENTS

| | | | |
|---|---|---|---|
| D. 268,042 | 2/1983 | Ng. | D12/1 |
| 2,758,900 | 8/1956 | Marchand | 362/129 |
| 3,111,275 | 11/1963 | Pfisterer | 362/136 |
| 3,684,344 | 8/1972 | Gilinger | 312/223 |
| 4,564,886 | 1/1986 | Morcheles | 362/97 |
| 4,629,264 | 12/1986 | Culver | 362/129 |

*Primary Examiner*—Ira S. Lazarus
*Assistant Examiner*—Sara Sachie Raab
*Attorney, Agent, or Firm*—Carnes, Cona and Dixon

[57] ABSTRACT

The present invention provides a device that is a combined night-light and table. The night-light table includes legs, a base, a top, and at least one light source located within the top. The top also includes a portion that is fabricated from a transluscent material for enabling the light from the light source to glow from the transluscent material. The top is secured to the base by way of a hinge so the top may be closed or opened. The night-light table lessens the danger of traveling near the table whenever dark and reduces the insecurity someone near the table might feel if otherwise placed in total darkness. The table provides support like conventional tables and may include lockable storage compartments. The night-light table may combine with a chair or stool for the comfort and convenience of users.

20 Claims, 4 Drawing Sheets

NIGHT-LIGHT TABLE

BACKGROUND OF THE INVENTION

1. Field of the Invention

The present invention relates generally to a table, and more particularly to a table that is adapted to function and operate as a night light.

2. Description of the Related Art

Several designs and styles of vanities exists today, as well as several designs for vanity tables. However, none of the vanities offer the unique feature of using the vanity as a night light when desired, in order to provide for an aesthetically pleasing atmosphere.

One example of a typical vanity is disclosed in U.S. Pat. No. 3,684,344 issued to Gilinger. Gilinger discloses a decorative space saving vanity which when utilized as a vanity provides a light source for an individual using a mirror. Though efficient in providing a means of enabling an individual to clearly view themselves using a light source and a mirror, this vanity is designed to be hung on a wall. This provides a vanity that cannot be used as a table nor can it be used as a night light.

Yet another device is disclosed in U.S. Pat. No. D268,040 issued to Ng. Ng discloses a toy vanity case that when opened exposes a mirror and a light source. This carrying case does not disclose a table structure, nor does this carrying case disclose that toy vanity case to be used as a night light.

What is needed is a table serving customary purposes, i.e., of providing support for various items, of providing eating surfaces or of providing work surfaces, while serving additionally night-light purposes, i.e., for lessening the danger of traveling and reducing feelings of insecurity whenever dark and when near the table. The present invention satisfies this need.

Previous inventive effort has failed to provide benefits intended with the present invention, such as providing a table with a night-light that is aesthetically pleasing, convenient, multi-purpose and useful to children or adults. Previous inventive effort additionally fails to suggest the combination of component elements disclosed and claimed herein.

The present invention achieves intended advantages, objectives and purposes through new, unobvious and useful combinations of component elements, resulting in a night-light table which is simple to use and which incorporates a minimum of functioning parts. The cost to manufacture and assemble the present invention remains reasonable by employing only abundant and readily available material.

SUMMARY OF THE INVENTION

The present invention provides a table that is adapted to be utilized as a vanity as well as a night light. Hence, providing a device that is gear towards children. This night light table comprises a base that is supported via a support means. A top is hingedly secured to the base and includes an interior area located between an outer surface (exterior panel) and an inner surface (cover).

The outer surface includes at least a portion having a translucent characteristic. An illumination means is located within the interior area of the top. This illumination means, when activated, will enable an aesthetically pleasing glow to be dispense via the translucent portion from the table when the top is in a closed position. The glowing will render the vanity table to act as a night light.

The inner surface is exposed when the top is in an opened position. This inner surface may includes a reflective surface that is surrounded by an illumination means. The interior of the base may include a plurality of compartments that can be used for storing small items.

The outer surface may include an artistic facade. This will provide a table that is both useful as well as enchanting.

Accordingly, it is the object of the present invention to provide for a vanity table that when assembled is geared towards younger children as well as rendering a vanity table which will stimulate and enhance the creativity and imagination of a child.

It is yet another object of the present invention to provide a night-light table which will over come the deficiencies, drawbacks, and disadvantages of conventional night lights or vanity tables.

Still another object of the present invention is to provide for a night-light table possessing multi-purpose characteristics for enabling the night-light table to be utilized as a table/desk, vanity and/or night-light.

It is still a further object of the present invention to provide a multi-purpose night-light table of simple construction conforming to conventional methods of manufacture so as to provide a device that will be easy to use, economically feasible, long-lasting and trouble free.

No currently manufactured product offers the advantages of the present invention. The present invention meets requirements of low initial cost, low operating cost, simplified design while requiring only minimal familiarity, faculty or education to successfully employ or enjoy the invention.

The foregoing outlines the more pertinent objects of the invention. These objects should be construed as merely illustrative of the more prominent applications and features of the intended invention. Many beneficial results are obtainable by applying the disclosed invention in different manners or by modifying the invention within the scope of the disclosure. Accordingly, a full understanding of the invention may be gained by referring to the detailed description of the preferred embodiments, the scope of the invention as defined by the claims and the accompanying drawings.

BRIEF DESCRIPTION OF DRAWINGS

Similar reference numerals refer to similar parts throughout the views of the drawings.

DESCRIPTION OF PREFERRED EMBODIMENT

Figure 1:
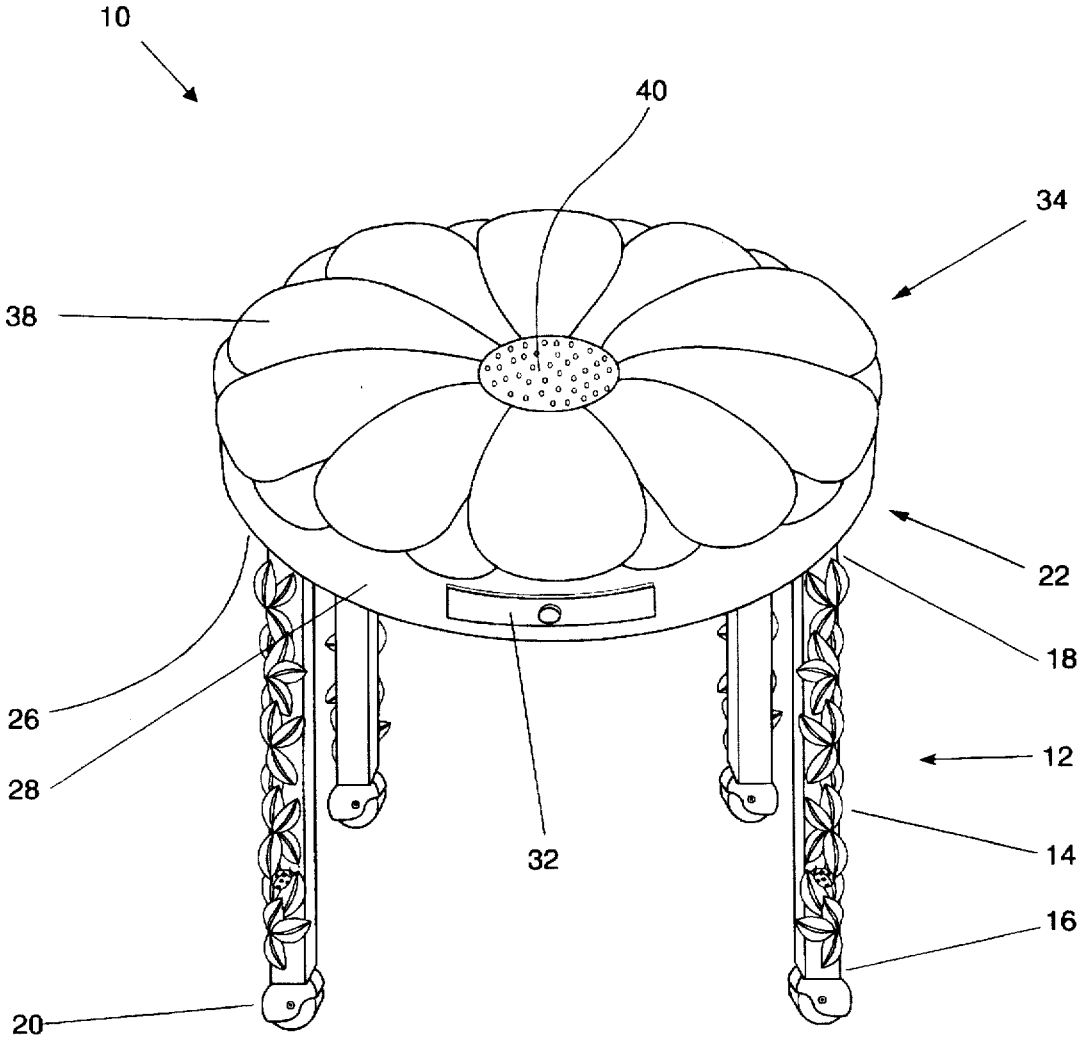
FIG. 1 is a perspective view of a night-light table of the present invention.
Figure 2:
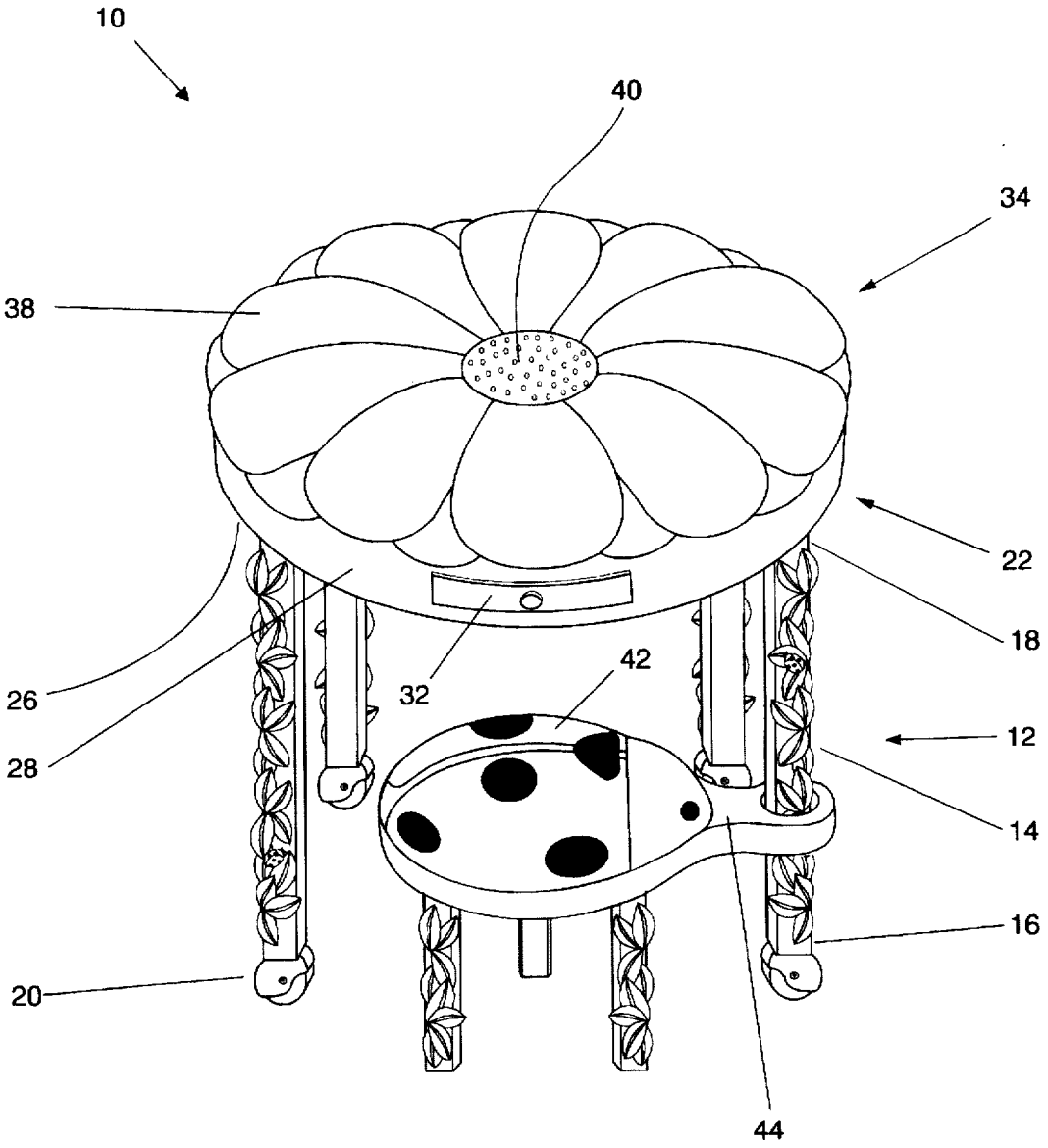
FIG. 2 is a perspective view of a night-light table of the present invention including a seating element attached thereto.
Figure 3:
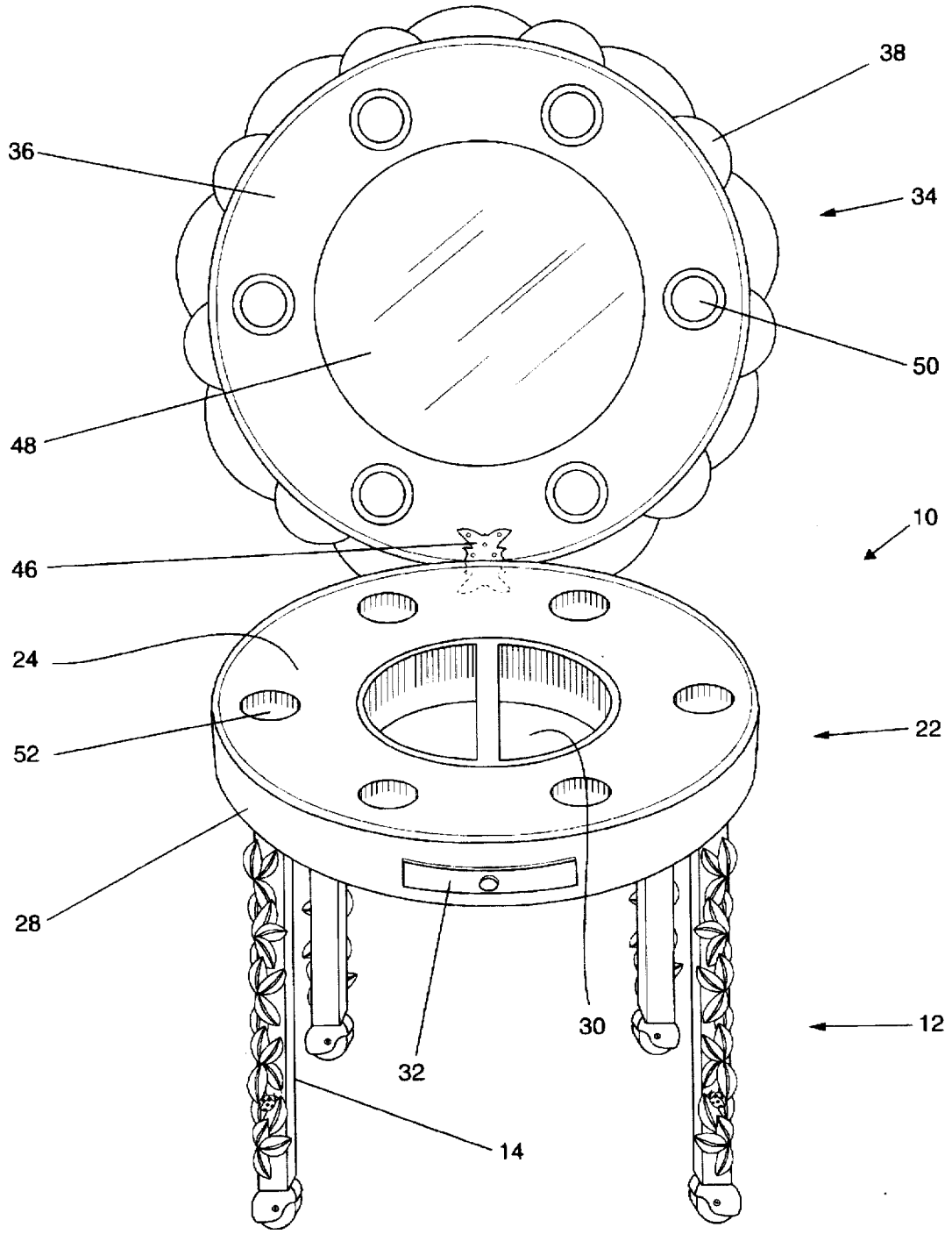
FIG. 3 is a perspective view of a night-light table of the present invention illustrating a top in an open position.

FIGS. 1–5 illustrate the preferred embodiment of the night light table of the present invention. As seen in FIGS. 1–3, the night light table 10 comprises a supporting means 12 that is adapted to support and maintain a base 22.

The supporting means includes a plurality of legs 14, each having a lower end 16 and an upper end 18. A lower end 16 of each leg may include a wheel 20 so as to provide for the night light table 10 to be mobile. Each wheel 20 can include a brake, so as to provide for the table to be in a fixed and stable position once placed in the desired location. The upper end 18 of each legs 14 is secured to the base 22.

The base 22 includes a lower surface 24 and an upper surface 26. The support means 12 is secured to the lower surface 24 of the base. The upper surface 26 can be flushed to enable the table to be utilized as a desk, or the like. An encompassing side wall 28 is located between the upper surface and the lower surface. Optionally, a plurality of compartments 30 can be located within the upper surface so as to provide a means for items to be stored. A drawer 32 may also be located within the sidewall 28 of the base so as to enable items to be stored therein.

It is noted that base is illustrated as including a circular shape, however other shapes and designs, such as square, rectangular, triangular, or the like, can be utilized for the base.

A top 34 is secured to the base 22 for enabling the upper surface 26 to be exposed when the top 34 is opened, or enabling the upper surface to be covered and protected when the top 34 is closed. The top may be locked to the base via a locking means 64. This locating device can be located internally within the base and top. This top 34 includes a cover 36 and an exterior panel 38.

The exterior panel 38 of the top 34 includes at least a portion that is constructed from a material having a translucent characteristic 40. This exterior panel 38 can be configured and designed so as to provide for an aesthetically pleasing product. As illustrated, the exterior panel 38 forms a flower, however, other designs and configurations can also be utilized, desired. To enhance the charm and appeal of the exterior appearance of the table 10 of the present invention, ornamental ornaments can be included on the legs. As illustrated in the figures, leaves, vines and ladybugs are utilized.

To add to the usefulness of the table device 10 of the present invention, a seating means 42 can be provided. This seating means 42 can be connected to one of the legs via a connecting means 44 for providing the seating means to be swingably connected to the support means. To augment the enchantment of the vanity and seating means 44, the seating means 44 can be designed and configured to correspond to the table. As illustrated in this figure, the seating means is configured as a ladybug.

The cover 36 is secured to the exterior panel 38 to render the top to be hollow, accordingly providing an interior area or space to be located between the cover 36 and the exterior panel 38. This cover is adapted to be removably secured to the exterior panel. The cover 36 includes an exterior surface that is exposed when the top is in an opened position. A hinged 46 is secured to the cover and to the base to provide for the top to be hingedly secured to the base. For enabling the individual to view themselves, the cover can be provided with a reflective surface 48. The cover can also includes at least one section that is constructed from a transluscent material. This section can be flush with the cover or optionally can be form to extend outwardly from the exterior surface of the cover. This arrangement provides for an illuminating means 50. The illuminating means 50 illustrated in the figures is designed and configured to depict light bulbs or optionally to be light bulbs. If the upper surface of the base is flushed with the sidewall of the base, then the base may include a plurality of receptacle means 52 which will enable the illuminating means 50 to be received and protected when the top is in a closed position.

Figure 4:
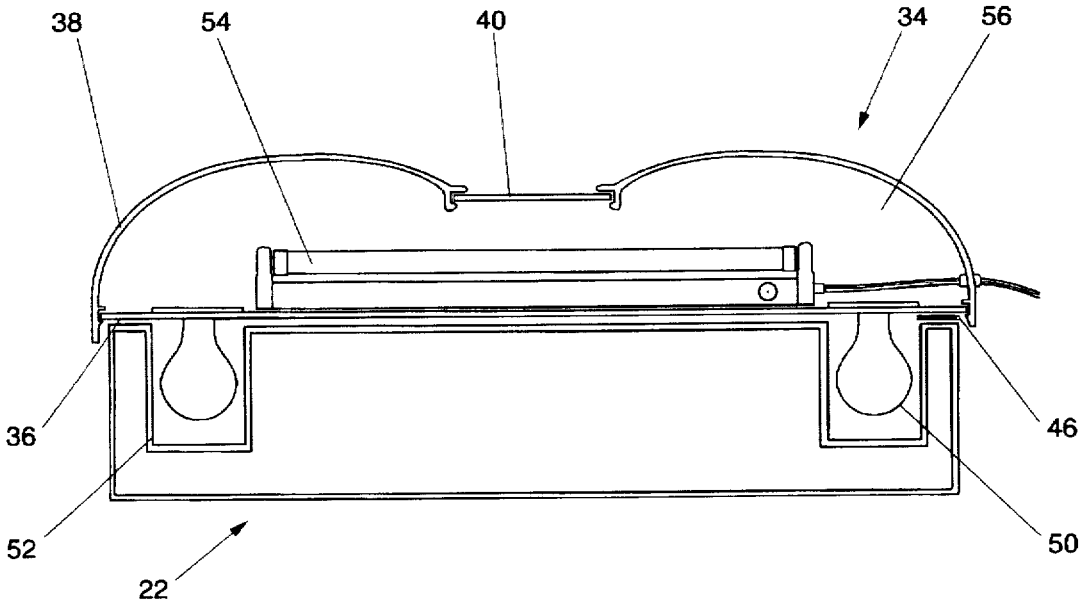
FIG. 4 is a section view of a night-light table of the present invention illustrating the use of one illumination means.
Figure 5:
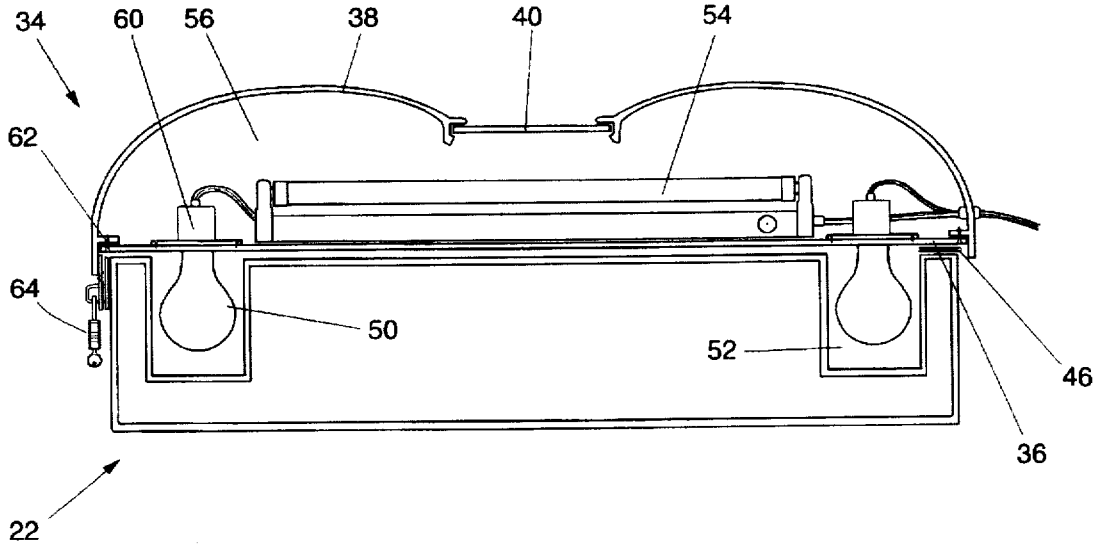
FIG. 5 is a partial section view of a night-light table of the present invention illustrating the use of two illumination means.

FIGS. 4 and 5 illustrate the various lighting means that can be utilized with the table 10 of the present invention. FIG. 4 illustrates the first embodiment of the illuminating means 50 of the present invention. As seen in FIG. 4, the illuminating means 50 comprises a plurality of extensions that are configured as light bulbs. These imitation light bulbs are fabricated from a translucent material. Located, secured and situated within the interior 56 of the top is a first conventional light source 54, such as a conventional fluorescent light fixture. This first conventional light source is electrically connected to a power source (not illustrated), such as a battery or wall socket (outlet) and a switch (not illustrated). Upon activation of the light fixture via the switch, the light source is able to travel through the translucent material 40 and 50. When the top 34 is in a closed position, as illustrated, the light source will emit a glow from the translucent material 40, to provide for the apparatus 10 to act as a night light. When the top 34 is in an opened position, light is also emitted from the imitation light bulbs 50.

The cover 36 is adapted to be removably secured to the exterior panel 38 to enable the light fixture 54 to be changed when necessary. As seen in this embodiment, the cover 36 is secured to the hinged 46. This end of the cover is also secured to the exterior panel. In order to remove the exterior panel, the user merely snaps off the exterior panel 38 from the cover 36, exposing the light fixture 54 and enabling its removal and replacement.

It is noted that the transluscent material can be flush with the cover, as opposed to extending outwardly from the cover. This will eliminate the need of receptacles, as well as provide the cover to be cleaned easily and effectively.

FIG. 5 illustrates an alternative embodiment for the illuminating means 50 of the present invention. As seen in this figure, the table 10 includes a first light source and a second light source. The illuminating means 50 includes a plurality of incandescent light bulbs 58 that are threadably secured to a housing 60. These housings 60 are electrically connected to a power source, such as a battery, wall socket, or the like and a first switch. This will provide for the first switch to activate or deactivate the plurality of incandescent light bulbs. A second light source 54 is located within the interior area 56 of the top 34. This second light source, such as a fluorescent light bulb, will enable the light to be transmitted through the translucent material 40. This second light source is electrically connected to the power supply and a switch (not illustrated). This switch can optionally be independent from the first switch.

The cover 36 is adapted to be removably secured to the exterior panel 38 to enable the light fixture 54 to be changed when necessary. As seen in this embodiment, the cover 36 is secured to the exterior panel 38 via bolts 62. In order to remove the exterior panel, the user merely unscrews the bolt 62 to enable the removal of the exterior panel from the cover 36, exposing the light fixture 54 and enabling its removal and replacement.

It is noted that the panel fabricated from the transluscent material can be adapted to be removably secured to the exterior panel 38. This will enable the user to alter the color and/or pattern emitted from the vanity. Optionally, this transluscent material can be coated with (exteriorly or interiorly) or be replaced with a phosphor substance. This will provide for the device to glow when the surrounding of the table is dark.

The transluscent material used on the cover can also be designed so as to be removably secured to the cover. This will enable the user to alter the color and/or pattern emitted from the cover. This will also enable easy maintenance of the device, by enabling the components to be cleaned and free of dust, dirt, or the like.

The night-light table 10 is preferably used by positioning the night-light table 10 in areas where the danger of traveling at night can be lessened and feelings of insecurity can be reduced. Children's bedrooms and hallways between bedrooms and bathrooms are ideal locations for the night-light table 10.

Still further use of the night-light table 10 is made when items are placed in the storage means 30 and secured with the locking means 64.

Accordingly it is seen that the device may optionally be used as a vanity/desk or a night-light. For use as a vanity/desk, the child need only to lift the top to provide for the cover to be exposed. Once exposed, the child may utilize the device as a table or the like. The illuminating means may be activated to render lighting to be disperse in the direction of the base. This illumination is ideal for enabling adequate lighting for a student or child while reading, writing, drawing, painting, or the like. If a reflective surface is provided on the exterior of the cover, then the lighting means can be provided around the reflective surface. This will give the illusion of a "grown-up" vanity, thereby rendering a table which will promote the creativity and imagination of a child.

During the night, the table can be transformed into a night light. In order to do so, the top is closed and secured to the base. The illuminating means is activated for permitting the illuminating means to glow from the translucent material.

While the invention has been particularly shown and described with reference to an embodiment thereof, it will be understood by those skilled in the art that various changes in form and detail may be made without departing from the spirit and scope of the invention.

We claim:

1. A night-light table comprising:

a support means having a lower end and an upper end;

a base having a lower surface and an upper surface;

said upper end of said support means is connected to said lower surface of said base;

a top having a cover and an exterior panel;

said cover of said top is hingedly connected to said upper surface of said base enabling said top to open and close;

said exterior panel of said top includes at least a portion of translucent character;

at least one illumination means is located in said top;

said illumination means radiating light omnidirectionally enabling light to transmit through said portion of translucent character of said top whether said top is in an opened or closed position; and said base further includes at least one storage means.

2. A night-light table as in claim 1 further comprising a seating device having a means for bearing a weight of a user for positioning user alongside said night-light table for comfortable access to said night-light table.

3. A night-light table as in claim 2 wherein said seating device is swingably connected to said support means via a connecting means.

4. A night-light table as in claim 1 wherein said illumination means comprising at least one fixture with at least one bulb selected from the group consisting of fluorescent, halogen, incandescent, low-voltage and neon.

5. A night-light table as in claim 1 further comprising a second illumination means, a first illumination means radiating light through said portion of translucent character of said top, said second illumination means for radiating light away from said cover of said top towards a user.

6. A night-light table as in claim 1 further comprising at least one wheel connected to said lower end of said support means for enabling said night light to be mobile.

7. A night-light table of as in claim 1 wherein a reflective surface is exteriorly located on said cover of said top for enabling viewing of a user.

8. A night-light table of claim 1 further including a reflective surface on said cover, a drawer located in said base, and a locking means for locking said top to said base.

9. A night-light table comprising:

a base;

a support means being secure to said base for supporting said base;

a top being secured to said base and said top being adapted to be opened for exposing an upper surface of said base and being adapted to be closed for exposing an exterior panel of said top;

an illuminating means being adapted to glow from said top; and said base further includes a plurality of compartments.

10. A night-light table as in claim 9 wherein said illuminating means is phosphor substance secured to said exterior panel.

11. A night-light table as in claim 9 wherein said base further includes a drawer.

12. A night-light table as in claim 9 further including a locking means for locking said top to said base.

13. A night-light table as in claim 9 wherein said top includes an interior area, said interior area is located between a cover and said exterior panel, said exterior panel includes a portion having transluscent characteristics, and said illuminating means is located within said interior area for enabling glowing to occur from said portion.

14. A night-light table as in claim 13 wherein said cover includes at least one section having transluscent characteristics for enabling glowing to occur from said at least one section.

15. A night-light table as in claim 14 wherein a reflective surface is located on said cover.

16. A night-light table as in claim 15 further including a locking means for locking said top to said base.

17. A night-light as in claim 16 wherein said base includes at least one storage compartment.

18. A night-light table as in claim 13 wherein a second illuminating means is adapted to glow from said cover.

19. A night-light table as in claim 13 wherein said cover is adapted to be removably secured to said exterior panel.

20. A night-light table comprising:

a base having an upper surface;

a support means being secured to said base for supporting said base;

a top being secured to said base and having an exterior panel and a cover;

said upper surface of said base and said cover of said top are exposed when said top is opened;

said cover and said upper surface are hidden from view and said exterior panel of said top is exposed when said top is closed;

an interior area is located between said exterior panel and said cover;

said top and said cover each include a portion having translucent characteristics; and an illuminating means is located within said interior area for enabling glowing to occur from said portion of said top and said portion of said cover.

* * * * *